United States Patent [19]

Nishimaki

[11] Patent Number: 4,996,932

[45] Date of Patent: Mar. 5, 1991

[54] MULTIPLE-NEEDLE PATTERN-STITCHING SEWING MACHINE

[75] Inventor: Shigetsugu Nishimaki, Ueda, Japan

[73] Assignee: Vari-O-Matic Machine Kabushiki Kaisha, Nagano, Japan

[21] Appl. No.: 428,691

[22] Filed: Oct. 30, 1989

[30] Foreign Application Priority Data

Mar. 13, 1989 [JP] Japan ..... 1-60379

[51] Int. Cl.[5] ..... D05B 3/04; D05B 1/08

[52] U.S. Cl. ..... 112/157; 112/80.31; 112/163; 112/303; 112/308

[58] Field of Search ..... 112/80.31, 157, 163, 112/164, 165, 166, 167, 303, 307, 308, 319

[56] References Cited

U.S. PATENT DOCUMENTS

| | | | |
|---|---|---|---|
| 414,514 | 11/1889 | Gaguin, Jr. | 112/308 |
| 1,693,524 | 11/1928 | Mundlos | 112/308 |
| 2,159,252 | 5/1939 | Brussell | 112/166 |
| 2,895,438 | 7/1959 | Shotsky | 112/164 |
| 3,026,832 | 3/1962 | Taketomi | 112/308 |
| 4,597,344 | 7/1986 | Stutznäcker | 112/80.13 X |
| 4,691,654 | 9/1987 | Meier | 112/303 |

FOREIGN PATENT DOCUMENTS

| | | | |
|---|---|---|---|
| 538881 | 11/1931 | Fed. Rep. of Germany | 112/308 |
| 671048 | 7/1989 | Switzerland | 112/157 |

*Primary Examiner*—Werner H. Schroeder
*Assistant Examiner*—Paul C. Lewis
*Attorney, Agent, or Firm*—Jordan and Hamburg

[57] ABSTRACT

The present invention relates to a multiple-needle sewing machine which is capable of making stitch tracings in zigzag, etc. on a cloth by moving up and down a plurality of needles, with the cloth held between a needle plate and a cloth holder and moved right and left. The needle plate has a long hole with such a length that the right and left movement of the needle plate is not hindered by the vertical movement of the plurality of needles. Within the long hole, there is a needle passing plate positioned which has needle holes through which the needles pass. This needle passing plate is formed shorter than the long hole of the needle plate so as not to hinder the right and left movement of the needle plate. Such a structure is effective for making finely a plurality of the same stitches in zigzag, etc.

4 Claims, 8 Drawing Sheets

MULTIPLE-NEEDLE PATTERN-STITCHING SEWING MACHINE

BACKGROUND OF THE INVENTION

The present invention relates to a multiple-needle pattern-stitching sewing machine which is capable of forming patterns in zigzag, etc. as a plurality of the same stitch traces.

Conventionally, as a zigzag sewing machine, a single-needle sewing machine has been known which comprises a sewing needle capable of vertical reciprocating movement and laterally-swinging movement and other means moving in coupling with this sewing needle.

In a multiple-needle sewing machine, the mechanism will be complicated if we make multiple-needles simultaneously laterally movable as the single needle. For this reason, one type of multiple-needle sewing machine forms stitch traces on a cloth by swinging laterally a cloth held between a needle plate and a cloth holder. In such a multiple-needle sewing machine, the needle-passing hole is made long enough for the needle plate moving right and left without hitting the needle.

The above-mentioned conventional multiple-needle sewing machine has the following disadvantages.

In the multiple-needle sewing machine which has the needle-passing hole formed as a long hole, when many needles simultaneously pierce into a cloth, this piercing force will push the cloth into the long hole, making stitching impossible or, even if possible, stitch lines so distorted that no neat stitch traces are formed.

As a countermeasure, the cloth is stretched on a frame to be sewn without being loosened, or is backed up with a thick paper before being sewn.

However, in these methods, as pretreatments before sewing, work is required to stretch the cloth on a frame or back up the cloth with a thick paper, etc. In addition, after sewing, it is necessary to detach the cloth from the frame or remove the back-up thick paper. These jobs are troublesome and tedious. No neat stitch traces may be obtained. Further, no mass production system is applicable.

Under such a situation, actually, multiple-needle sewing machines have hardly been applied to formation of patterns in zigzag, etc.

SUMMARY OF THE INVENTION

The object of this invention is to offer a multiple-needle pattern-stitching sewing machine which is capable of simultaneously forming a plurality of the same zigzag patterns, etc.

This invention is concerned with a multiple-needle sewing machine comprising a plurality of needles positioned in a direction almost perpendicular to the cloth feed direction, a needle plate having holes through which the plurality of needles can penetrate and having a cloth guided on the upper face thereof, and a pressing device placed vertically movable above the needle plate and having a holding piece which presses the cloth between it and the needle plate when the pressing device moves downward, the improvement comprising a link mechanism connecting the needle plate which is movably provided in a horizontal plane in the direction perpendicular to the cloth feed direction and the pressing piece in the pressing device which is supported slidably in the direction perpendicular to the cloth feed direction, means for driving the needle plate and the pressing piece in the direction perpendicular to the cloth feed direction in synchronization with the vertical movement of the plurality of needles, and a needle passing plate positioned within the hole, which is of such a length that the movement of the needle plate is not hindered by the plurality of needles, the needle passing plate having needle holes through which each of the plurality of needles and the needle passing plate being fixed on a suitable material so as to be flush with the upper face of the needle plate.

In addition, in such an above-described multiple-needle sewing machine employing a vertical looper to intertwine a needle thread at the tip of a needle entering the needle hole with a lower thread, guide grooves may be formed in the needle holes of the needle passing plate in the cloth feed direction and extending off the looper relative to the needle.

A cloth held between the needle plate or feed teeth and the holding piece is moved horizontally. In synchronization with this movement, the needle is moved up and down together with the cloth being moved backward, thus stitches are formed on the cloth.

Also, the cloth is supported by the needle passing plate when the needles pierce into the cloth, and thus the cloth is not pushed into the long hole.

BRIEF DESCRIPTION OF THE DRAWINGS

The present invention will be apparent from the following description, reference being had to the accompanying drawings wherein preferred embodiments of the present invention are clearly shown.

In the drawings.

DETAILED DESCRIPTION OF PREFERRED EMBODIMENTS

Preferred embodiments of the present invention will now be described with reference to accompanying drawings.

Figure 1:
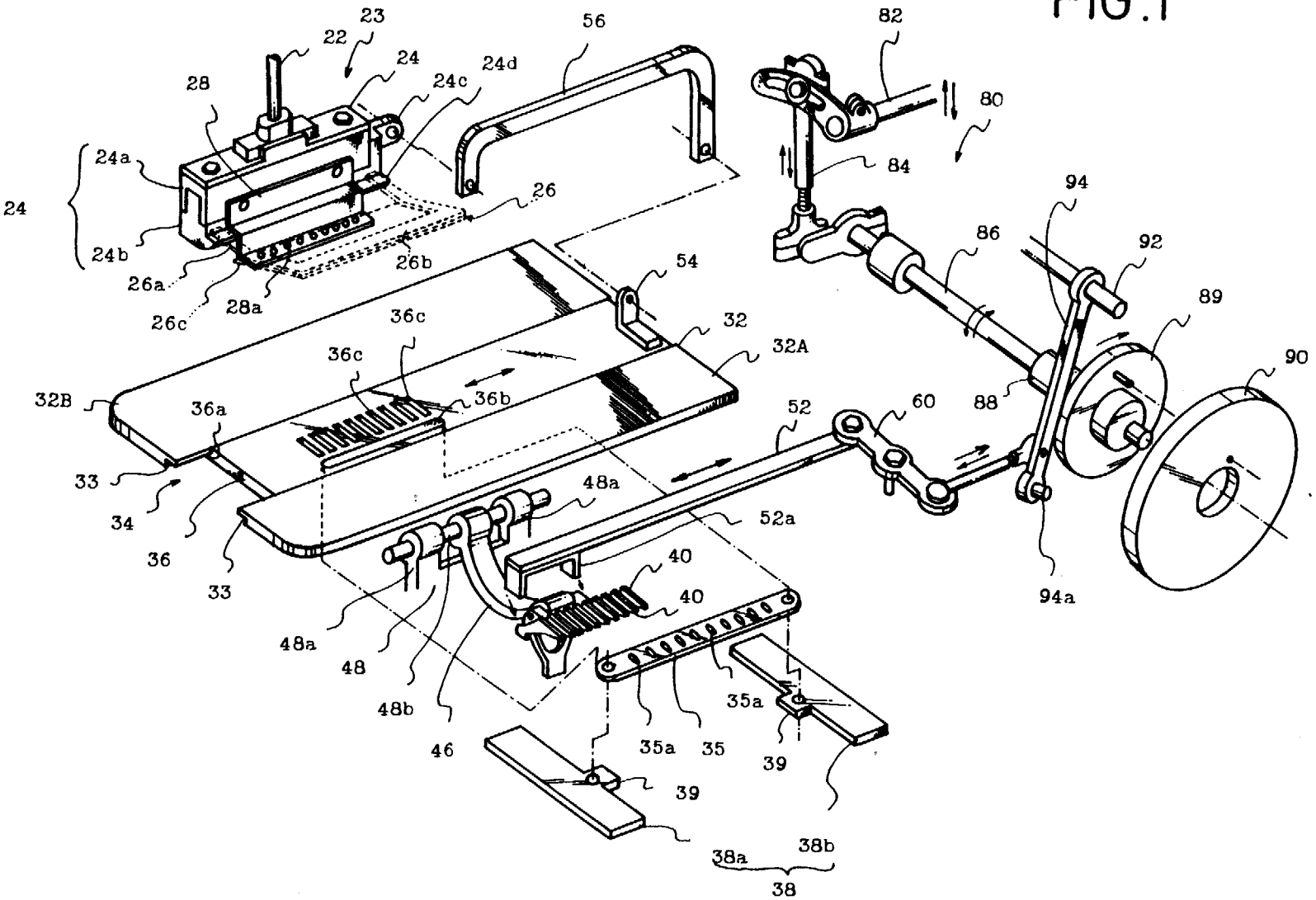
FIG. 1 is a partial exploded perspective view illustrating the essential parts of the multiple-needle sewing machine of the present invention.
Figure 2:
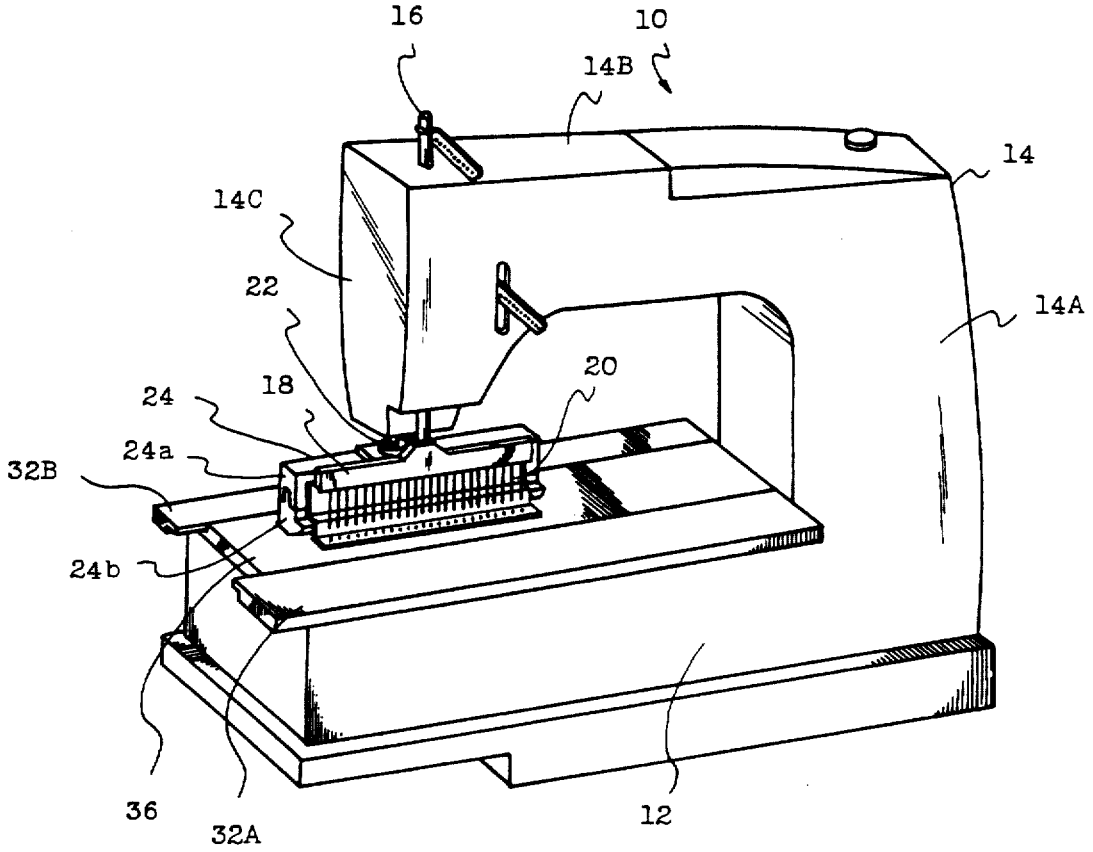
FIG. 2 is a schematic perspective view of the same machine as the above one.
Figure 3:
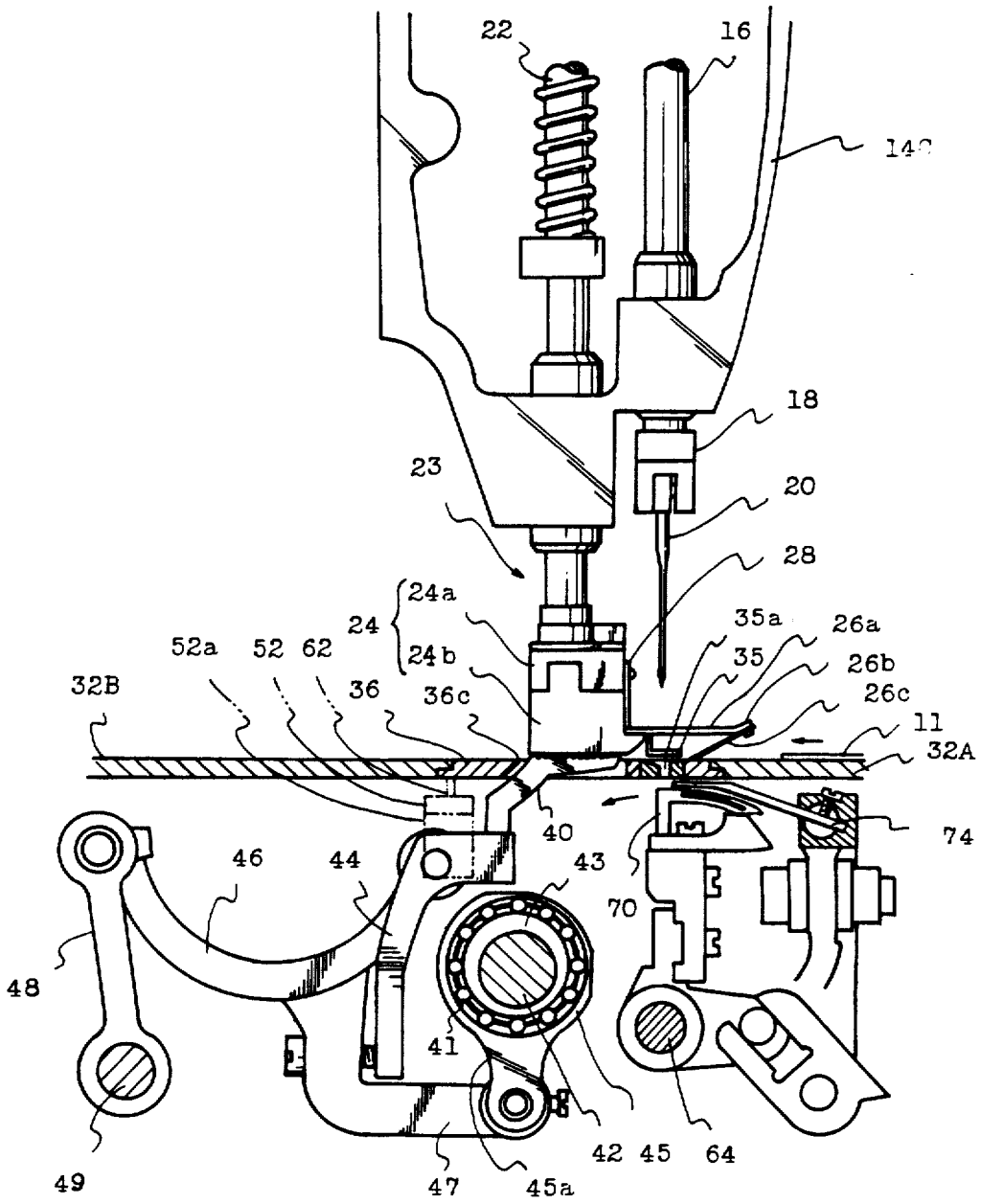
FIG. 3 is a partially sectional side view illustrating the internal mechanism of the same machine as the above one.
Figure 4A:
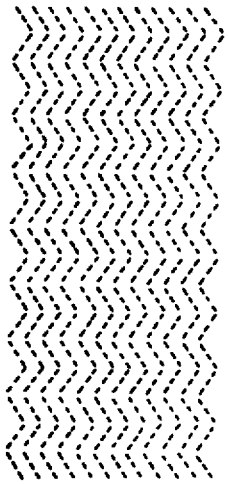
FIGS. 4(*a*)–(*h*) are explanation views of stitch traces.
Figure 4B:
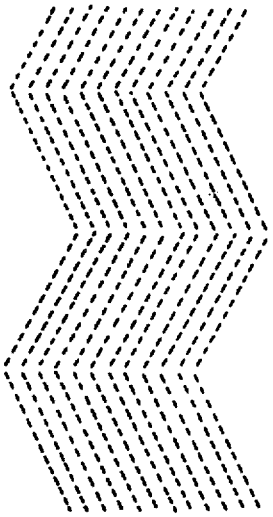
Figure 4C:
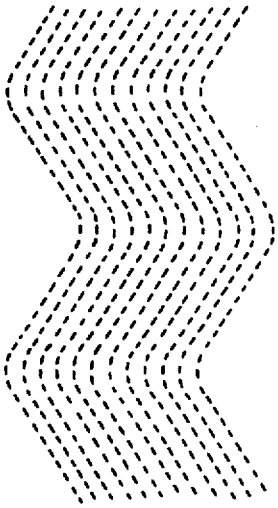
Figure 4D:
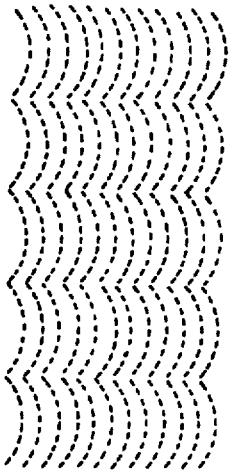
Figure 4E:
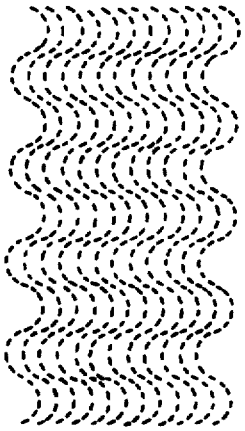
Figure 4F:
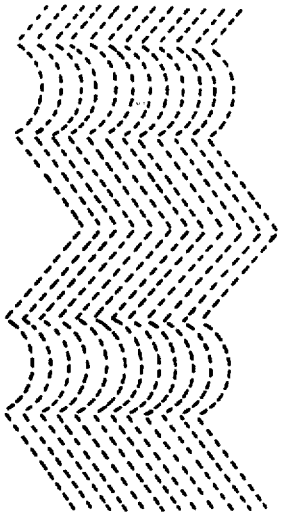
Figure 4G:
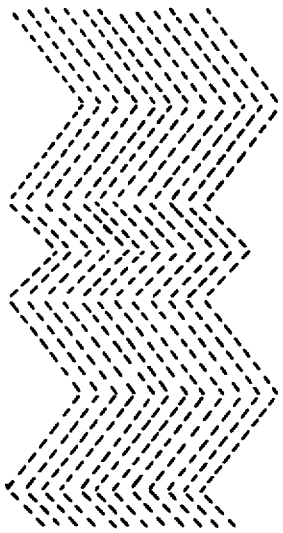
Figure 4G:
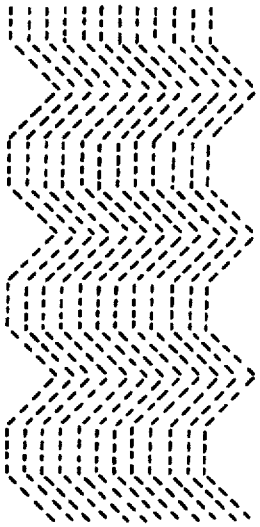

FIG. 1 is a partial exploded perspective view of the multiple-needle sewing machine. FIG. 2 is a schematic perspective view of the multiple-needle sewing machine. FIG. 3 is a partially sectional side view illustrating the internal structure. This embodiment refers to a stitch sewing machine.

As FIG. 2 shows, an arm 14 extends upward from the end section of a bed 12 of a multiple-needle sewing machine 10. This arm 14 is composed of a vertical section 14A, a horizontal section 14B, and a needle-rod guide section 14C. This needle-rod guide section 14C is penetrated vertically by a needle rod 16, and this needle rod 16 is moved up and down by driving force from a driving source via a known transmission mechanism. At the lower end of the needle rod 16 is fixed a needle holder 18, and on the bottom face of this needle holder 18 are fixed a plurality of needles 20 extending downward.

Now, a pressing device 23 will be explained.

As is clear from FIGS. 1 and 3, the pressing device 23 comprises a pressing rod 22, which is provided on the needle-rod guide section 14C parallel to the needle rod 16 and movable up and down, and a pressing piece 24 provided at the lower end of the pressing rod 22. The pressing piece 24 is composed of a fixed part **24*a*, which, as a support, is fixed at the lower end of the pressing rod 22 and a movable pressing part 24*b*, which is laterally with respect to the fixed part 24*a*. On a step part 24*d* projecting forth from the movable pressing part 24*b* is fixed a guide piece 26. Both the open ends of a U-shaped frame piece 26*a* forming the guide piece 26 are fixed on the step part 24*d* of the movable pressing part 24*b*. And, the tip edge 26*b* of the frame piece 26*a* is bent upward, and the tip edge 26*b* is provided with a downward-extending guide plate 26*c*. This guide plate 26*c* guides a cloth 11**.

In addition, on the front face of the fixed part **24*a* is fixed a pressing metal piece 28. This pressing metal piece 28 is bent stepwise, extending downward along the step part 24*d* of the movable pressing part 24*b*. And the front tip of the pressing metal piece 28 is a horizontal part 28*a*, and the horizontal part 28*a* has holes corresponding to the needles 20** in number.

The pressing device 23 is designed to be moved up and down by a known up-down driving mechanism in such a way that it may be positioned at the lower position to which the device descends to hold a cloth and at the upper position to which the device ascends to put the cloth into a free state.

On the other hand, on the bed 12 is provided a cloth plate 32 to put the cloth 11 on. This cloth plate 32 includes a front cloth plate 32A on the front side of the multiple-needle sewing machine and a back cloth plate 32B on the back side, and the front cloth plate 32A and back cloth plate 32B are fixed with a space 34 therebetween. In the space 34 the needle plate 36 is provided and is slidable in the right and left directions of the multiple-needle sewing machine 10. This needle plate 36 and the pressing piece 24 hold the cloth 11 therebetween.

The cloth plate 32 is fixed on a fixing plate 38. The fixing plate 38 is composed of two sub-fixing plates **38*a* and 38*b* positioned nearly parallel to each other. These sub-fixing plates 38*a* and 38*b* are fixed on the base of the multiple-needle sewing machine 10. On the back sections of these sub-fixing plates 38*a* and 38*b* is fixed the back cloth plate 32B, and on their front sections is fixed the front cloth plate 32A**.

And, on the middle sections of the sub-fixing plates **38*a* and 38*b* are provided projections 39 projecting toward each other. On the projections 39 is fixed a needle passing plate 35. The needle passing plate 35 has needle holes 35*a*, 35*a* . . . bored therein through which the needles 20** . . . penetrate.

On the opposite edges of the above-described front cloth plate 32A and back cloth plate 32B there are formed cuts on their bottom sides as guides 33, 33. On the other hand, on both the edges, in the width direction, of the needle plate 36, there are formed steplike catching edges **36*a*, 36*a*. These catching edges 36*a*, 36*a* of the needle plate 36 are guided slidably by the guides 33, 33 of the front cloth plate 32A and the back cloth plate 32B**.

The needle plate 36 has a laterally-long hole **36*b* at the position corresponding to the needle passing plate 35 (on the front edge part of the needle plate 36). The long hole 36*b* has the needle passing plate 35 received therein, but the long hole 36*b* is longer in the lateral direction. Thus, although the needle passing plate 35 is fixed, the needle plate 36 can slide in the lateral direction without being disturbed by the needle passing plate 35**.

Next, a cloth feed mechanism will be explained.

A plurality of feed-teeth holes **36*c* are provided in parallel at right angle to the long hole 36*b* of the needle plate 36**.

Immediately below the needle plate 36 is provided feed teeth 40. These feed teeth 40 correspond respectively to each feed-teeth hole **36*c*, are positioned in each feed-teeth hole 36*c***, and can move back and forth and up and down.

The structure and movement of the feed teeth 40 will be explained by reference to FIGS. 1 and 3.

Immediately below the needle plate 36 is horizontally provided a rotary shaft 42 extending in the direction of movement of the needle plate 36. On the rotary shaft 42 is fixed an eccentric piece 43. On the outer circumference of the eccentric piece 43 is provided a link piece 45 with a needle bearing 41. The link piece 45 has an arm **45*a* extending downward. Note that the link piece 45 is capable of sliding along the needle bearing 41 in the direction vertical to the drawing paper of FIG. 3 (in FIG. 2, the link piece 45 can slide in the right-left direction of the multiple-needle sewing machine 10**).

On the other hand, the feed teeth 40 are fixed on a feed-teeth fixing base 44. This feed-teeth fixing base 44 has an L-shaped side positioned in an inverted L form. At the horizontal tip of the feed-teeth fixing base 44 are fixed the group of feed teeth 40, and to the bent part thereof is rotatably attached a feed transfer arm 46. The feed transfer arm 46 is extended backward (in the left direction in FIG. 3) from the feed-teeth fixing base 44. The back end of the feed transfer arm 46 is connected to a swing arm 48. The through-holes provided in a bifurcated support section **48*a*, 48*a* at the upper part of the swing arm 48 are penetrated by a slide rod 48*b*. The slide rod 48*b* is connected to the back end of the transfer arm 46**.

The arm **45*a* of the link piece 45 and the feed transfer arm 46 are connected with each other by a connection arm 47**.

Thus, a rotation of the rotary shaft 42 causes the link piece 45 to rotate. This rotation is transmitted to the feed-teeth fixing base 44 via the connection arm 47 and the feed transfer arm 46, allowing the feed teeth 40 fixed on the feed-teeth fixing base 44 to move up and down.

On the other hand, the swing arm 48 swings on a swing shaft 49. The swing of the swing arm 48 is in connection with the rotary shaft 42. And the swing of the swing arm 48 is transmitted to the feed-teeth fixing base 44 via the transfer arm 46, allowing the feed teeth 40 to move back and forth.

Thus, the back-and-forth movement transmitted via the swing arm 48 and the up-and-down movement which the rotation of the rotary shaft 42 transmits via the link piece 45, are synchronized with each other and allow the feed teeth 40 to get into a loop movement with resulting backward transfer of the cloth. This loop movement is in synchronization with the up-and-down movement of the needles 20.

Thus, the loop movement of the feed teeth 40 consists of the following four actions:

(1) when the needle 20 having been piercing the cloth 11 gets drawn out, the feed teeth 40 ascend, and press the cloth 11 against the bottom face of the pressing piece 24;

(2) when the needle 20 gets drawn out, the feed teeth 40 move backward and send the cloth 11 backward;

(3) when the needle descends, the feed teeth 40 also descend; and (4) when the needle 20 pierces the cloth 11 and the needle thread and the lower thread get intertwined, the feed teeth 40 move forward.

The movements (1)–(4) may trace either a rectangular or an elliptic form.

Drive means will be explained which moves the needle plate, the pressing piece 24, and the feed teeth 40 right and left.

To the connection part between the feed transfer arm 46 and the feed-teeth fixing base 44, there is connected the tip of a transfer arm 52 which serves to move the feed-teeth fixing base 44 in the direction perpendicular to the direction of cloth feed. At the tip of this transfer arm 52 is provided with a catching nail 52*a* which is in the form of an arch and open downward. The back end of the transfer arm 52 is connected to drive means 80 which moves the transfer arm 52 in the horizontal direction. When the drive means 80 drives the transfer arm 52, the group of the feed-teeth fixing base 44, the feed transfer arm 46, the connection arm 47, and the link piece 45 is caused to move right and left on the needle bearing 41.

Since the feed teeth 40, fixed in one unit on the feed-teeth fixing base 44, are located in the feed-teeth holes 36*c* . . . in the needle plate 36, the movement of the feed-teeth fixing base 44 is followed by the needle plate 36, which is moved by the feed teeth 40.

In coupling with the movement of the needle plate 36, the movable pressing part 24*b* of the pressing piece 24 is slided in the same direction as the movement of the needle plate 36. On the end part of the needle plate 36 located toward the base section of the arm 14 there is fixed a coupling piece 54 with an L-shaped side. And, on the side of the movable pressing part 24*b* of the pressing piece 24, there is formed a flange part 24*c*. The coupling piece 54 of the needle plate 36 and the flange part 24*c* of the movable pressing part 24*b* are each rotatably connected to each of the ends of a coupling rod 56 in the form of arch. Therefore, the horizontal right-left movement of the needle plate 36 is followed by a movement of the movable pressing part 24*b* of the pressing piece 24 together with the needle plate 36. Accordingly, the cloth 11 held between the needle plate 36 and the movable pressing piece 24 is caused to move as the needle plate 36 moves.

On the other hand, since both the ends of the coupling rod are rotatably connected, the pressing piece 24 can move up and down.

In the above-described embodiment, the transfer arm 52 is to the connected section between and connected to the feed transfer arm 46 and the feed-teeth fixing base 44, but the following modification can be allowed.

A pin 62 (shown by one dotted chain line in FIG. 3) projects from the upper face of the transfer arm 52, and this pin 62 is engaged with a catching part provided on the lower face of the needle plate 36, with resulting direct transmission for the movement of the transfer arm 52. This mechanism may be used together with the method of transfer of the above-described embodiment using the catching nail 52*a*.

Also, for the direct transmission of the movement of the transfer arm 52 to the needle plate 36, only the feed teeth 40 may be made movable with the needle plate 36 with respect to the feed-teeth fixing base 44.

The drive means 80 will be explained by reference to FIG. 1.

The other end of the transfer arm 52 is connected to one end of a lever plate 60 whose middle point is rotatably attached.

On the other hand, a main driving rod 82 is provided vertically movable from the driving source, and a transmission shaft 86 is rotated in the normal and reverse directions by a shaft 84 coupled to the main driving rod 82. By a ratchet piece 88 provided at the front end of the transmission shaft 86, a plate 89 provided in one unit on the ratchet piece 88 is rotatable only in one direction. The plate 89 has a cam plate 90 fixed thereto, and one face of this cam plate 90 has a cam groove (not shown) engraved. On the other hand, a cam lever 94*a*, provided at the front end of a cam arm 94 whose one end is rotatably attached to a shaft 92, is engaged with the cam groove on the cam plate 90. And, the middle section of the cam arm 94 and the other end of the lever plate 60 are rotatably assembled with each other. Accordingly, a vertical movement of the main driving rod 82 will rotate the ratchet piece 88 intermittently in only one direction, and this rotation moves the transfer arm 52 in the direction perpendicular to the cloth feed direction along the cam groove of the plate 70.

Note that the intermittent movement of the ratchet piece 88 is to arrange the proper timing for the needles 20 and the feed teeth 40.

Successively, the action of the machine will be explained.

The cloth 11 is put on the cloth plate, the pressing piece 24 is made to descend, and the cloth 11 is held between the needle plate 36 and the pressing piece 24.

Then, the multiple-needle sewing machine 10 is put into operation. The needle rod 16 is first driven up and down, the needles 20 . . . fixed on the needle holder 18 descend, pierce the cloth 11, and further penetrate the needle hole 35*a* of the needle passing plate 35. Then, within the multiple-needle sewing machine 10, the known retainer and looper operate to intertwine the upper and lower threads.

Then, when the needle is drawn out of the cloth, the feed teeth 40 send backward the cloth held by the pressing piece 24. For straight stitching, this action will be repeated.

Next, the actions in pattern stitching in zigzag trace, etc. will be described.

For zigzag stitching, the transfer arm 52 is first moved gradually in one direction. In connection with the movement, the feed-teeth fixing base 44 is moved on the needle bearing 41 with the link piece 45. The movement of the feed-teeth fixing base 44 makes the feed teeth 40 move the needle plate 36. Then, the cloth 11 held between the needle plate 36 and the pressing piece 24 is moved in the direction perpendicular to the cloth feed direction. Between these movements, the needles 20 move up and down to make a stitch on the cloth 11. Successively, when the transfer arm 52 is moved gradually in the reverse direction, the needle plate 36 and the movable pressing part 24*b* are moved in the reverse direction, and sequentially stitches in the reverse direction will be made. A repetition of this action will result in a formation of a zigzag pattern [see FIG. 4(*a*)].

And, when the needles 20 . . . pierce the cloth 11, the bottom side of the cloth 11 is supported by the needle passing plate 35, so that the cloth 11 is not pushed into the needle hole 35*a*, and thus neat stitches can be obtained.

Now, the timing for moving the cloth right and left will be explained. The timing is divided into two kinds.

The first timing is for the case where the cloth 11 is moved right and left when no needles 20 are piercing the cloth 11.

In this timing, when the needles 20 come out of the cloth 11, the feed teeth 40 go up to send backwards the cloth 11 held by the feed teeth 40 and the pressing piece 24, and at the same time, the feed teeth 40 are moved in the lateral direction by the transfer arm 52, then a stitch is made.

The second timing is for the case where the cloth 11 is moved in the lateral direction when the needles 20 are piercing the cloth 11.

In this timing, when the needles 20 are piercing the cloth 11, the feed teeth 40 do not send the cloth 11 backward, but are positioned on a slightly lower level (corresponding to (3) and (4) in the previously-mentioned loop action). At this positioning, the cloth 11 held between the needle plate 36 and the pressing piece 24 is partially moved laterally. Then, when the needles come out of the cloth 11, the portion of the cloth 11 with the needle 20 piercing is moved laterally so as to be in alignment with the portion of the cloth 11 held by the pressing piece 24.

The difference between the first and second timings is simply whether the cloth 11 is moved right and left with the needles 20 in or out of the cloth 11, and both the timings are practically adoptable. For the selection, the material, thickness, etc. of the cloth 11 are taken into account.

Note that various patterns can be obtained by suitably controlling the speed and amount of the movement of the transfer arm 52.

Concrete examples are shown in FIGS. 4(*a*)–(*h*). FIGS. 4(*a*) and (*b*) show zigzag patterns. Zigzag patterns in the form of an arc such as shown in FIGS. 4(*d*) and (*e*) are available. A variety of variations are made available by combination of arc, zigzag, and straight traces [see FIGS. 4(*c*), (*f*), (*g*) and (*h*)].

In addition, by reference to FIG. 1, an explanation has been given of the driving system for the mechanical means of the transfer arm 52 in the above-described embodiment. However, there are other means available. For example, a threaded rod may be connected to the motor so that the transfer arm 52 may move back and forth along the threaded rod. Note that suitable motors are such as a gear motor, a pulse motor, and a servo motor. Further, the transfer arm may be allowed to move back and forth directly by using an actuator such as an air cylinder, etc. Note that the control of the motor, etc. may be simply executed by known control means.

Next, the needle passing plate 35 will be explained in more detail.

In the above-described embodiment, even if the needle passing plate 35 is not provided at the position corresponding to the long hole 36*b* of the needle plate 36, zigzag patterns can be formed. However, this configuration is handicapped in that the cloth 11 is apt to be pushed into the long hole 36*b*, and is actually inapplicable as the conventional example has verified.

Figure 5A:
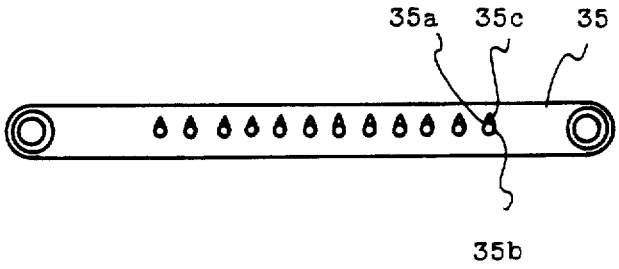
FIGS. 5(*a*) and (*b*) are a plan and a transverse sectional view, respectively, of the needle passing plate.
Figure 5B:
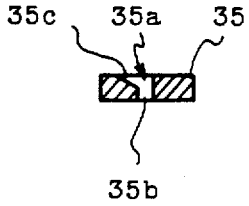

The needle hole 35*a* of the needle passing plate 35, as shown in FIG. 5(*a*), is long longitudinally, and has a through-hole 35*b* formed at its front section, and the through-hole is connected to a guide groove 35*c* extending backward. This guide groove 35*c* is to guide the lower thread sewn on the cloth 11 [see FIG. 5(*b*)].

The action of the needles, looper, and retainer will be explained by reference to FIG. 7. FIGS. 7(*a*) and (*d*) are plan views illustrating the positional relations of the looper and retainer. Note that the looper used in this embodiment is the so-called vertical looper.

As shown in FIG. 3, the looper 70 and the needle 20 are provided so as to be paired. And, the looper 70 is rotatable on the shaft 64, and the retainer is movable in the direction vertical to the drawing face of FIG. 3.

In FIG. 7(*a*), when the looper 70 rotates backward, the front tip of the retainer 74 catches the lower thread 72 at the front tip of the looper 70, and the retainer 74 moves in the upper right direction in the drawing, allowing a loop part 72*a* to be formed on the lower thread 72. Then, in this state the needle 20 descends toward into the loop part 72*a* with the looper 70 retiring, and when the needle 20 enters the loop part 72*a*, the retainer 74 moves to the left. And, when the needle 20 ascends, the looper 70 moves forward to hook the upper thread (needle thread), allowing the needle thread and the lower thread 72 to be intertwined.

Note that dotted lines show the needle hole 35*a* and the lower thread 72*b* sewn on the cloth.

On the other hand, when the cloth 11 is moved to the right, the lower thread 72*b* sewn on the cloth 11 is moved to the right together with the cloth 11, is detached from the guide groove 35*c*, and gets into the inside of the machine from the right end, on the drawing, of the through-hole 35*b*. These actions result in the loop part 72*a* having been stretched so as to be widened [see FIG. 7(*b*)].

In contrast to the above situation, when the cloth 11 is moved to the left, as shown in FIG. 7(*c*), the lower thread 72*b* sewn on the cloth 11 on the needle plate 36 is pulled to the left. Then, the lower thread 72*b* comes out of the guide groove 35*c* and gets into the inside of the machine from the left corner of the through-hole 35*b*. This sequence causes the lower thread 72 to cross the through-hole 35*b*, making the loop part 72*a* small, so that the needle 20 can hardly go into the interior of the loop part 72*a* as to make unsuccessful stitching. This is because, since the guide groove 35*c* of the through-hole 35*b* is extended straight backward, the lower thread 72 is so easy to get out of the guide groove 35*c* as to be pulled to the left.

Figure 6:
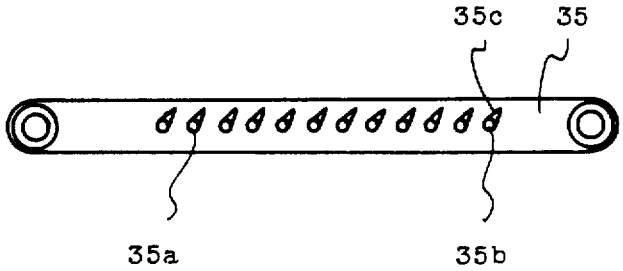
FIG. 6 is a plan view of a needle passing plate.
Figure 7A:
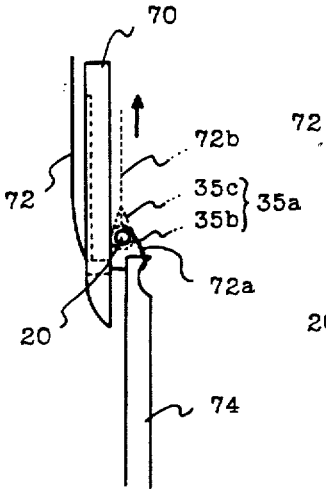
FIGS. 7(*a*)–(*d*) are explanation views of the operational states of the looper, retainer, and needle.
Figure 7B:
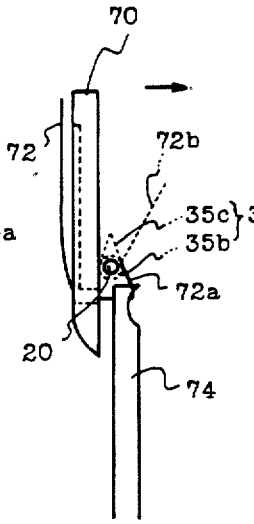
Figure 7C:
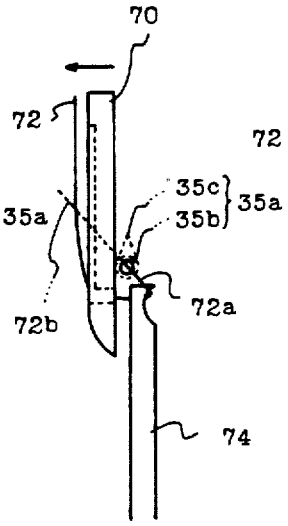
Figure 7D:
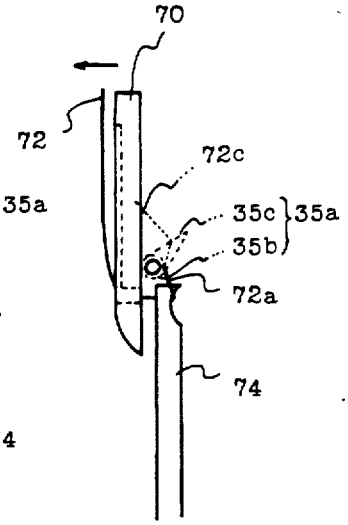
Figure 8A:
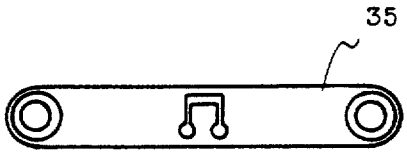
FIGS. 8(*a*)–(*d*) are plan views showing examples of modified needle passing plates.
Figure 8B:
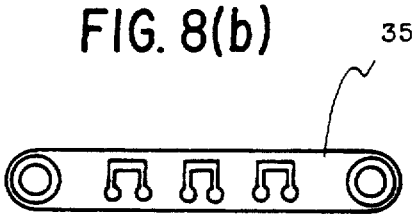
Figure 8C:
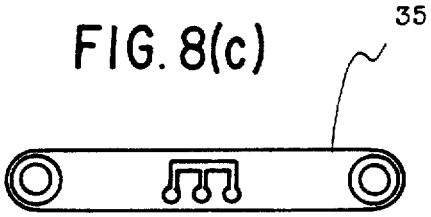
Figure 8D:
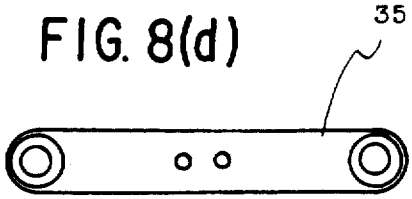

As a countermeasure, as shown in FIG. 6, the back section (the forward section in the cloth feed direction: upward in the drawing) of the guide groove 35*c* of the needle hole 35*c* of the needle passing plate 35 is to be inclined to the right. The reason for this effect will be explained successively. It is related to the movement of the needle 20, looper 70, and retainer 74.

As shown in FIG. 7(*d*), since the guide groove 35*c* of the needle hole 35*a* of the needle passing plate 35 is made to extend to the right, the lower thread sewn on the cloth 11 maintains the state of being guided by the guide groove 35*c* more effectively than in the conventional system. With this structure even if the cloth 11 is moved to the left, the lower thread 72*c*, without being pulled to the left, is allowed to enter the machine from the right end section (in FIG. 7) of the through-hole 35b, forming the loop part 72a larger than in the conventional system. Note that, when the cloth 11 is moved to the right, the loop part 72 is formed as large as in the conventional system.

On the other hand, when the guide groove 35c is not inclined, the needle hole 35a of the needle passing plate 35 is to be designed for the cloth 11 to be fed in the lateral direction in a small amount.

FIGS. 8(*a*)–(*d*) show other examples of needle passing plates.

FIG. 8(*a*) shows an example of needle passing plate 35 to be used for a lateral-looper sewing machine. The two needle holes 35 are connected to intertwine one lower thread with two needle threads. FIG. 8(*b*) is a modification of FIG. 8(*a*) adopting three 2-hole groups.

In FIG. 8(*c*), three holes are provided to intertwine one lower thread with the needle threads of three needles 20, and are connected by a groove.

In FIG. 8(*d*), two holes are provided. This is a needle passing plate 35 which is to be used for final sewing on home-use sewing machines.

In the above-described embodiments, formation of stitches has been used as an example for explanation, but the concept of the invention can be applied not only to stitch formation but also to the formation of pintacks, pleats, darts, etc. For example, if a pintack forming mechanism, a pleat forming mechanism, a dart forming mechanism, and so on are provided before the cloth plate, various pintack, pleat, and dart patterns, in the form of zigzag traces, etc. can be formed. In addition, the number of needles in the multiple-needle sewing machine is not restricted.

The present invention has the following remarkable effects.

The same patterns such as zigzag pattern may be formed simultaneously in a large number, since the needles are driven while the cloth, kept held between the pressing piece and the needle plate or the feed teeth, is moved right and left (in the direction perpendicular to the cloth feed direction).

Also, the needle passing plate does not disturb the movement of the needle plate, and the cloth is not pushed into the long hole, thus resulting in the formation of neat zigzag patterns, etc., since the needle passing plate, fixed on the sewing machine proper, is provided within the long hole of the needle plate, and also is provided in the bored needle holes at the positions corresponding to the needles.

Further, if the guide groove connected to the needle holes provided in the needle passing plate is extended off the looper for each needle, the ring of the lower thread formed by the lower thread can be formed so smoothly as to cause no occurrence of unsuccessful stitching, etc.

What is claimed is:

1. A multiple-needle sewing machine comprising a plurality of needles positioned in a direction almost perpendicular to a cloth feed direction, a needle plate having holes through which said plurality of needles can penetrate and having a cloth guided on an upper face thereof, and a pressing device placed vertically movable above said needle plate and having a holding piece which presses the cloth between in conjunction with said needle plate when said pressing device moves downward, the improvement comprising, a link mechanism connecting said needle plate which is movably provided in a horizontal plane in the direction perpendicular to the cloth feed direction and a pressing piece in said pressing device which is supported slidably in the direction perpendicular to the cloth feed direction:

means for driving said needle plate and said pressing piece in the direction perpendicular to the cloth feed direction in synchronization with the vertical movement of said plurality of needles; and a needle passing plate positioned within said hole, said hole being elongated so that movement of said needle plate is not hindered by said plurality of needles, said needle passing plate having needle holes through which each of said plurality of needles passes, and said needle passing plate fixed on a suitable material so as to be flush with the upper face of said needle plate.

2. A multiple-needle sewing machine comprising a plurality of needles positioned in a direction almost perpendicular to a cloth feed direction, a needle plate having holes through which said plurality of needles can penetrate and having a cloth guided on an upper face thereof, a pressing device placed vertically movable above said needle plate and having a holding piece which presses the cloth between in conjunction with said needle plate when said pressing device moves downward, and a feed mechanism placed behind said needle plate, facing through-holes bored in said needle plate from said needle plate, and having feed teeth which move in loop in a vertical plane in synchronization with vertical movement of said plurality of needles to hold the cloth between in conjunction with a pressing piece and send the cloth, the improvement comprising, a link mechanism connecting said needle plate which is movably provided in a horizontal plane in the direction perpendicular to the cloth feed direction and said pressing piece in said pressing device which is supported slidably in the direction perpendicular to the cloth feed direction;

means for driving said needle plate, said pressing piece and said feed teeth in the direction perpendicular to the cloth feed direction in synchronization with the vertical movement of said plurality of needles;

a support section supporting said feed teeth movable in the direction perpendicular to the cloth feed direction, said support section is provided in said feed mechanism; and a needle passing plate positioned within said hole, said hole being elongated so that movement of said needle plate is not hindered by said plurality of needles, said needle passing plate having needle holes through which each of said plurality of needles passes, and said needle passing plate fixed on a suitable material so as to be flush with the upper face of said needle plate.

3. A multiple-needle sewing machine according to claim 1 further comprising, a vertical looper to intertwine needle thread at a tip of said needles entering said needle hole with a lower thread; and a guide groove extending in the cloth feed direction and also off said vertical looper with respect to said needles.

4. A multiple-needle sewing machine according to claim 2 further comprising, a vertical looper to intertwine needle thread at a tip of said needles entering said needle hole with a lower thread; and a guide groove extending in the cloth feed direction and also off said vertical looper with respect to said needles.

* * * * *